US008317021B2

(12) United States Patent
Christopher

(10) Patent No.: US 8,317,021 B2
(45) Date of Patent: Nov. 27, 2012

(54) TOOL SET PACKAGE

(75) Inventor: Brent Christopher, Portland, OR (US)

(73) Assignee: Meridian International Co., Ltd. (CN)

( * ) Notice: Subject to any disclaimer, the term of this patent is extended or adjusted under 35 U.S.C. 154(b) by 0 days.

(21) Appl. No.: 13/076,668

(22) Filed: Mar. 31, 2011

(65) Prior Publication Data

US 2012/0043238 A1 Feb. 23, 2012

(30) Foreign Application Priority Data

Aug. 17, 2010 (CN) ..... 2010 2 0293908 U
Nov. 4, 2010 (CN) ..... 2010 3 0595207

(51) Int. Cl.
*B65D 85/28* (2006.01)

(52) U.S. Cl. ..... 206/375; 206/349; 206/234

(58) Field of Classification Search ..... 206/375–379, 206/234, 349, 372, 374
See application file for complete search history.

(56) References Cited

U.S. PATENT DOCUMENTS 2,532,636 A * 12/1950 Minnich ..... 206/377
6,050,409 A * 4/2000 Delbeck et al. ..... 206/375
7,210,578 B2 * 5/2007 Tuan-Mu et ..... 206/378
7,938,261 B1 * 5/2011 Lee ..... 206/376
8,038,004 B2 * 10/2011 Hu ..... 206/375
2006/0016706 A1 * 1/2006 Chen ..... 206/379
2006/0070902 A1 * 4/2006 Tuan-Mu et al. ..... 206/378
2009/0255840 A1 * 10/2009 Lin ..... 206/379
2011/0088519 A1 * 4/2011 Hu ..... 81/63.1
2012/0000805 A1 * 1/2012 Liu ..... 206/372

* cited by examiner

*Primary Examiner* — Mickey Yu
*Assistant Examiner* — Rafael Ortiz
(74) *Attorney, Agent, or Firm* — Jason R. Sytsma; Shuttleworth & Ingersoll, PLC

(57) ABSTRACT

A packaging arrangement is provided for displaying a tool set and a plurality of interchangeable work pieces at a point of sale that is useable as a carrying case after it is purchased. The packaging arrangement has an insert with a plurality of receptacles at spaced apart intervals between the outer ends for individual reception of the interchangeable work pieces. A locking member is provided with the insert and is moveable between an engaged position and a disengaged position to selectively secure the interchangeable work pieces in the receptacles of the insert.

23 Claims, 11 Drawing Sheets

TOOL SET PACKAGE

The present application claims priority under 35 USC §119 to Chinese application 201020293908.3 filed Aug. 17, 2010, and Chinese application 201030595207.0 filed Nov. 4, 2010, which are incorporated herein by reference.

BACKGROUND

This invention relates to a multi-functional case for displaying a hand tool and interchangeable work pieces at a point of sale and storing the hand tool and the interchangeable work pieces thereafter.

Tool sets with multiple interchangeable work pieces are customarily sold in disposable packaging. It is often desirable to store the work pieces in an organized manner after the point of sale so they may be easily located. Systems of the prior art for storing such work pieces include separate tool boxes. Sometimes, separate tool boxes are provided in the packaging with the tool set. Such an arrangement, however, increases the cost of the tool set. To date, no economical and commercially available tool set storage system is available that incorporates the packaging for displaying the set at the point of sale with the convenient carrying case

SUMMARY

A packaging arrangement is provided for displaying a tool set and a plurality of interchangeable work pieces at a point of sale that is useable as a carrying case after it is purchased. The packaging arrangement has an insert with a plurality of receptacles at spaced apart intervals between the outer ends for individual reception of the interchangeable work pieces. A locking member is provided with the insert and is moveable between an engaged position and a disengaged position to selectively secure the interchangeable work pieces in the receptacles of the insert.

Each interchangeable work piece has an outer surface and a working axis. The receptacle receives the work piece around the outer surface of the work piece that is generally parallel to the working axis of the work piece. In the engaged position, the locking member engages the outer surface of the work piece to secure the work piece to the packaging.

In an alternative embodiment, a case for holding and displaying a hand tool and a plurality of interchangeable work pieces at a point of sale is provided. An insert is combined with a base for the packaging. The insert has outer ends with a plurality of receptacles at spaced apart intervals between the outer ends for individual reception of the interchangeable work pieces. A locking member is combined with the insert and is moveable between an engaged position and a disengaged position to selectively secure the interchangeable work pieces in the receptacles of the insert. The receptacles are adapted to receive the work piece in at least one the following manners (i) around a first portion of an outer surface of the work piece that is generally parallel to a working axis of the work piece, and the locking member in engaged position touchingly engages a second portion of the outer surface of the work piece that is generally parallel to the working axis of the work piece, (ii) wherein the receptacle is defined by an arm protruding outward, the arm adapted to receive the work piece about its center such that the arm is generally aligned with a working axis of the work piece, and (iii) an indentation formed in a top surface of the receptacle, the top surface being parallel to a customer facing side of the case, the indentation shaped generally as the work piece, such that the work piece is cradled in the indentation.

In yet another embodiment, a package for holding and displaying a hand tool and a work piece for the hand tool at a point of sale is provided. The package has a base that is adapted to secure the hand tool to the base at the point of sale. At least one cut-out is formed in a profile of the base to receive a removable and exchangeable insert, which is adapted to hold the work piece secure to the insert at the point of sale. The insert has a plurality of receptacles at spaced apart intervals therealong for individual reception of the interchangeable work pieces, and a locking member attached to the insert and moveable between an engaged position and a disengaged position to selectively secure the interchangeable work pieces to the insert.

DRAWINGS

These and other features and advantages of the present invention will be better understood by reading the following detailed description, taken together with the drawings wherein:

FIG. 1 is a perspective view of the case for a hand tool and interchangeable bits stored therein on opposite sides;

FIG. 2. is an exploded view of the insert and the locking member from the left side of FIG. 1;

DETAILED DESCRIPTION

Figure 1:
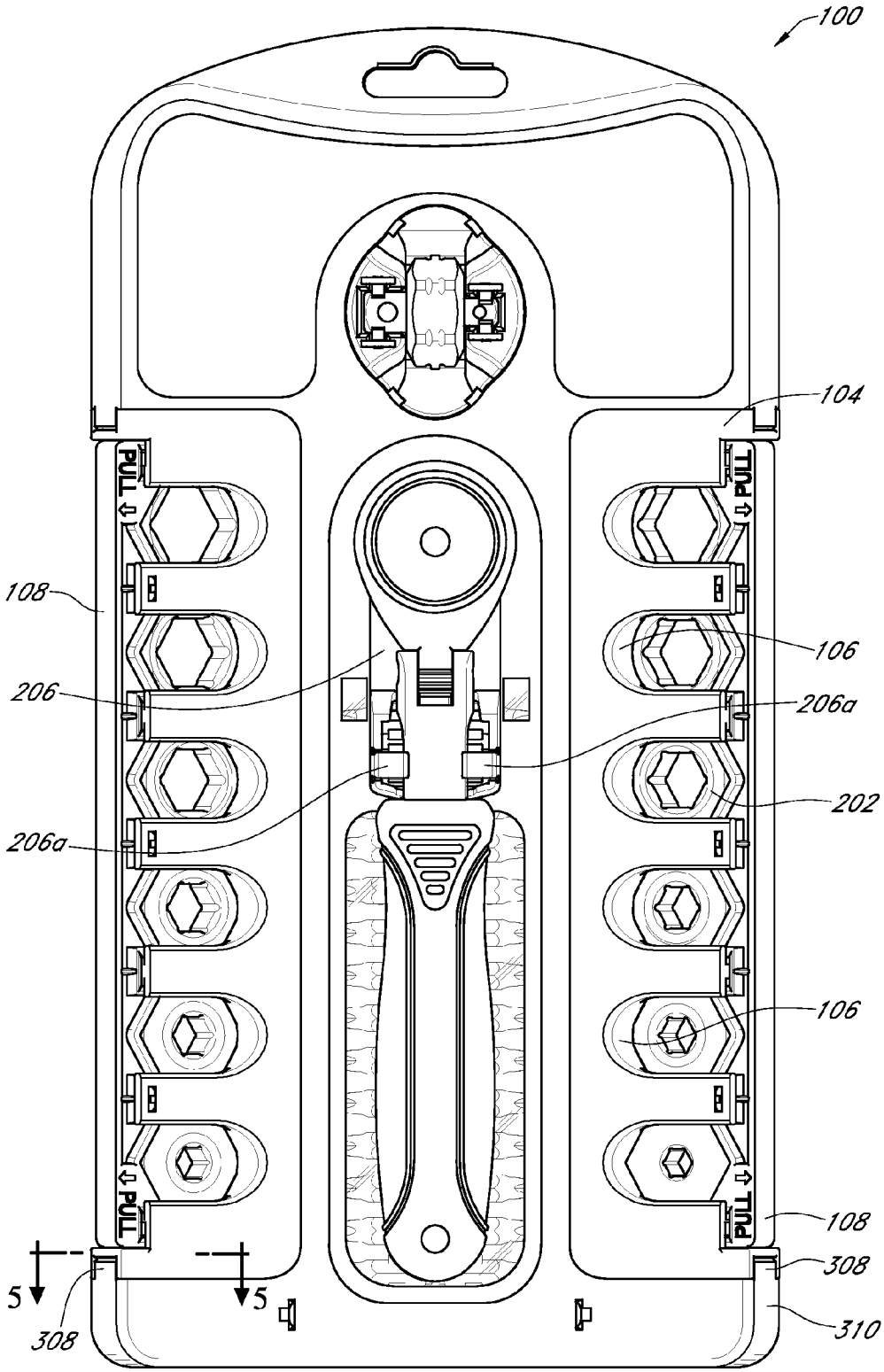
Figure 4:
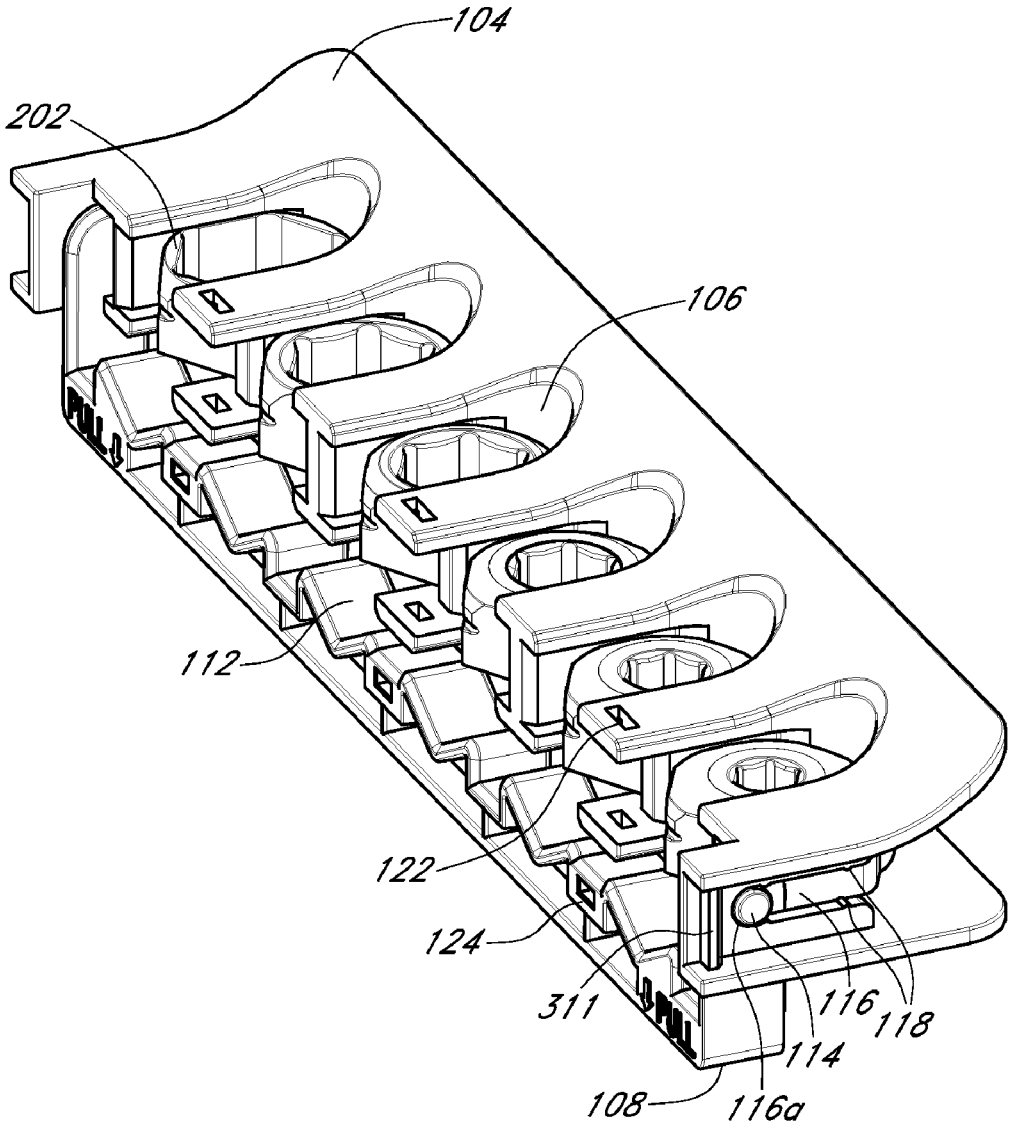
FIG. 4 is a perspective view of the insert and the locking member of FIG. 3 with the locking member in the disengaged position.
Figure 5:
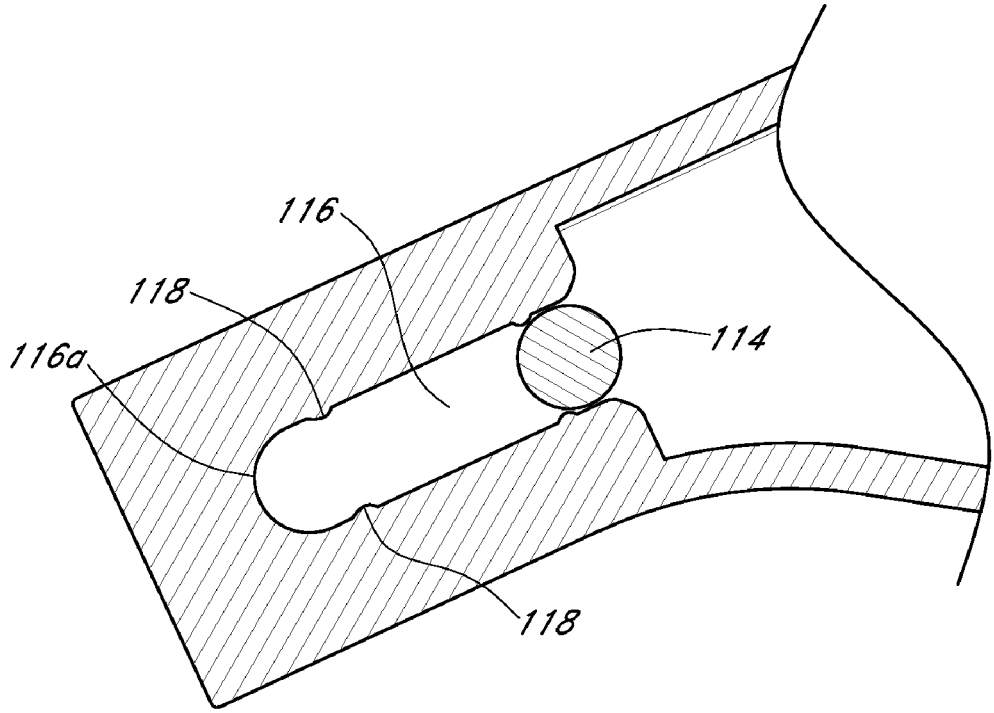
FIG. 5 is a sectional view along the line A-A in FIG. 1 illustrating the sliding head of the locking member.
Figure 6:
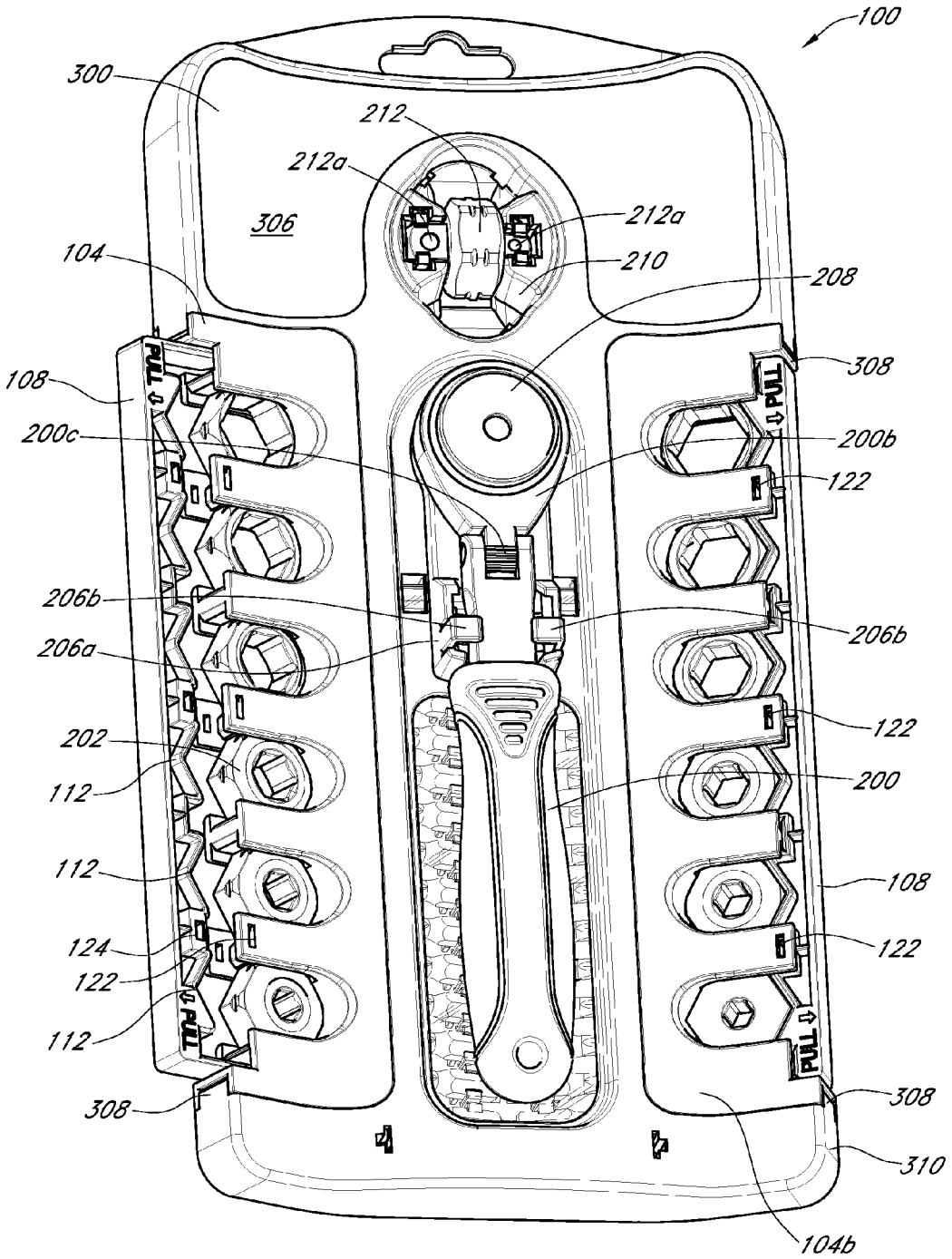
FIG. 6 is a perspective view of the case of FIG. 1 with the hand tool engaged with the case and the locking member on the left side extended from the insert between the engaged position and the fully disengaged position.
Figure 7:
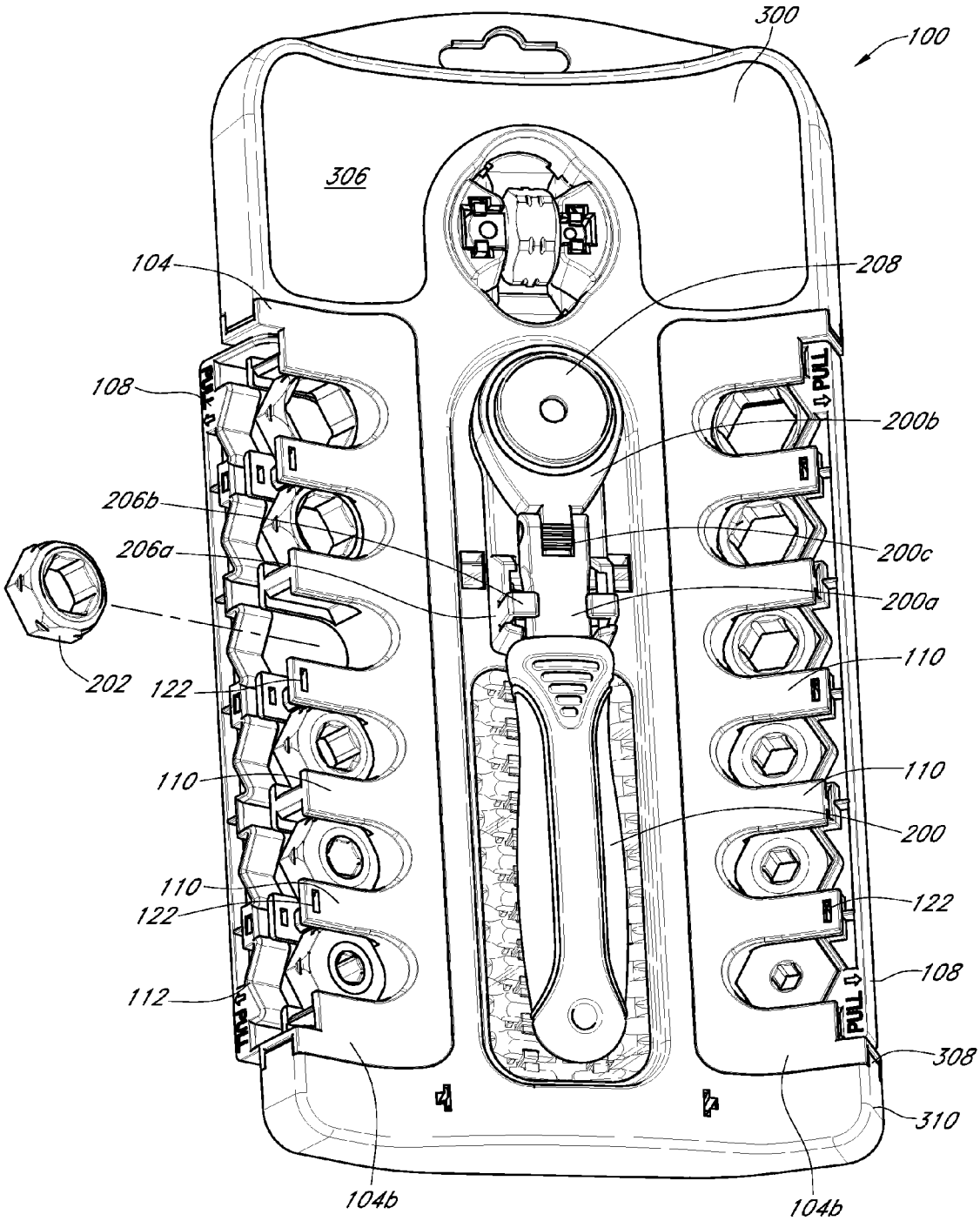
FIG. 7 is a perspective view of the case of FIG. 6 with the hand tool engaged with the case and the locking member on the left side in the disengaged position with a socket apart form the socket receptacle.
Figure 8:
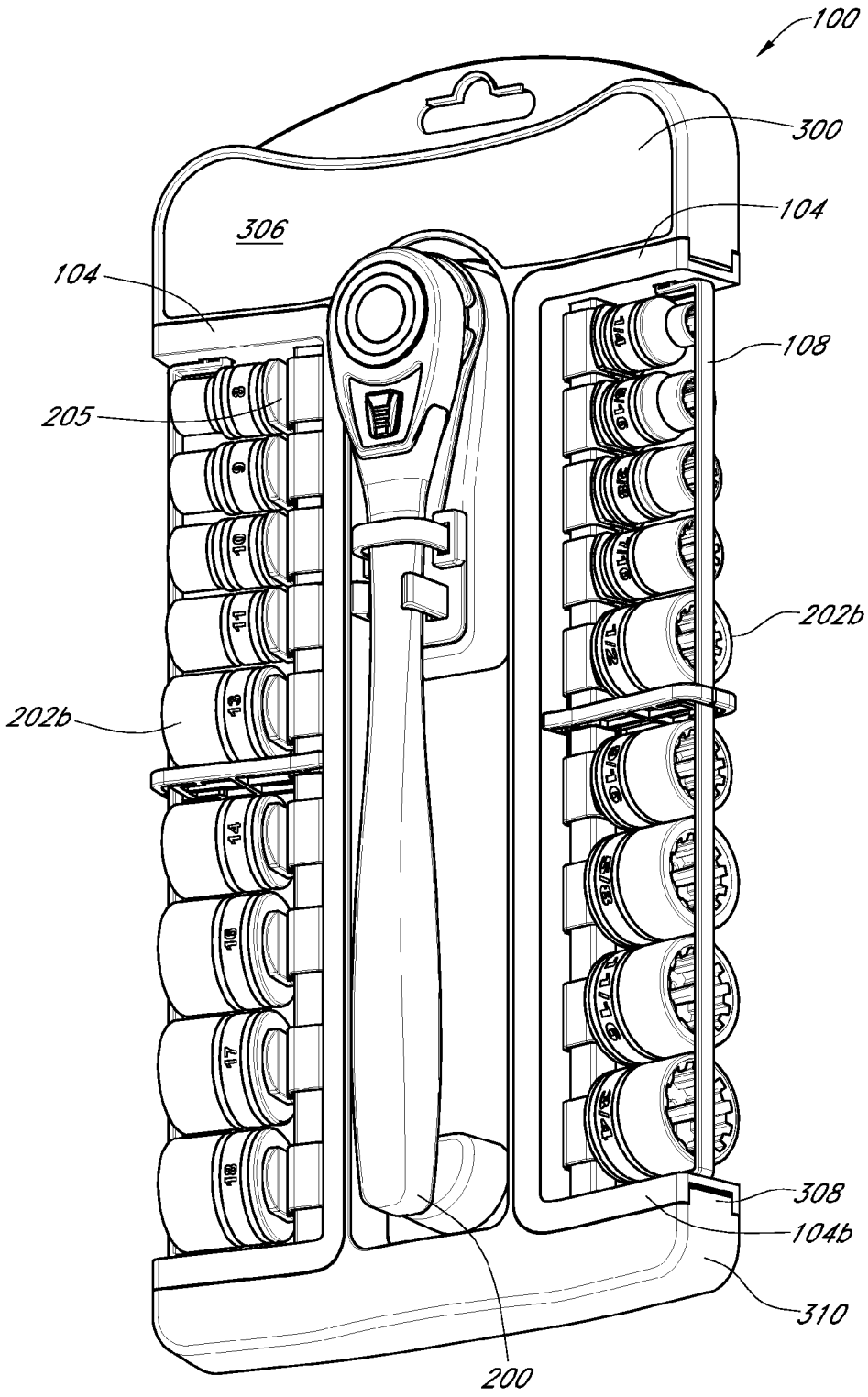
FIG. 8 is a perspective view of an alternative embodiment of the case.

In the illustrated embodiment of FIGS. 1-7, a case 100 for holding a hand tool 200 and a plurality of interchangeable sockets 202 is provided. Case 100 generally includes at least one removable holder or insert 104 positioned on a side of case 100 with a plurality of receptacles 106 at spaced apart intervals therealong for individual reception of interchangeable sockets 202. FIGS. 1, 6 and 7 show a removable insert 104 on each side of case 1000. A locking member 108 is provided for selective retention of interchangeable sockets 202 to provide a display and a convenient user carrying case 100 for hand tool 200 and interchanging sockets 202.

Figure 2:
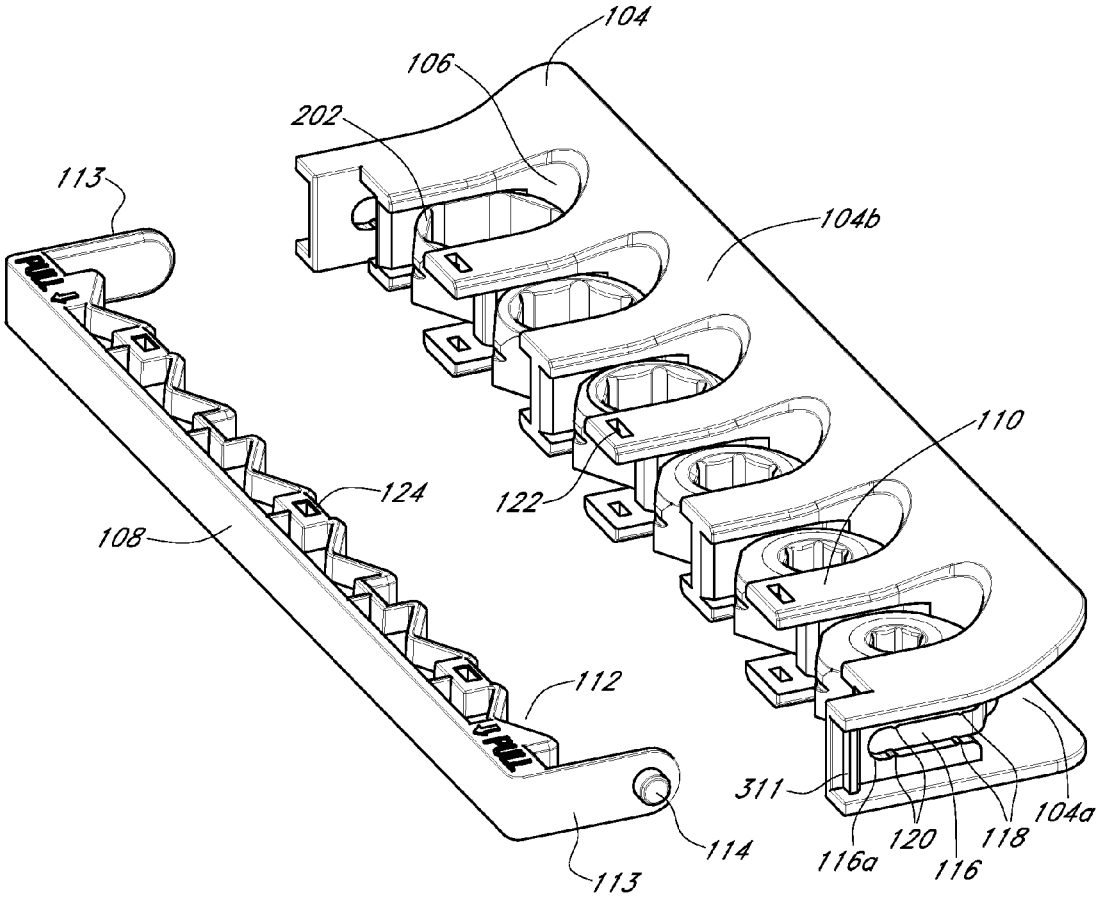

Referring to FIG. 2, left side insert 104 and locking member 108 are illustrated apart from case 100. Insert 104 is generally rectangular in shape with a substantially flat bottom 104*a* and an inwardly and upwardly sloping top 104*b*. A plurality of spaced apart arms 110 in top 104*b* and bottom

104*a* with voids therebetween define receptacles 106. From an edge view, arms 110 have a generally I-shaped profile, where the two lateral portions of the I-shape define bottom 104*a* and top 104*b* of insert 104 and perpendicular portion 104*c* of the I-shape extending therebetween corresponds to the depth of a socket 202. Receptacles 106 constrain sockets 202 on opposing sides and on their top and bottom faces so that a socket 202 can be removed from the insert 104 only by sliding the socket 202 outwardly toward the locking member 108 when locking member 108 is disengaged.

FIG. 2 shows locking member 108 extending the length of insert 104 to secure sockets 202 in receptacles 106. Referring to FIG. 6, on the right hand side of case 100, locking member 108 is illustrated in the engaged position with sockets 202 secured in receptacles 106. On the left hand side of case 100, locking member 108 is illustrated partially between the engaged position and the disengaged position to demonstrate the manner in which locking member 108 is pulled outwardly to become disengaged. As best seen in FIGS. 2 and 4, locking member 108 has a plurality of v-shaped grooves 112 corresponding to the number of socket receptacles 106. The exterior surfaces of sockets 202 are hexagonal and sockets 202 are positioned in receptacles 106 with a point (defined by a conjunction between two sides of the hexagon) extending outward from receptacle 106. In the engaged position, a V-shaped groove 112 mates with a point of a socket 202. Each socket 202 is secured entirely around its periphery by adjacent perpendicular portions 104*c* of arms 104 to prevent lateral movement, and each socket 202 is secured on a portion of their top and bottom faces by bottoms 104*a* and tops 104*b* of arms 110 to prevent upward and downward movement.

Locking member 108 moves between an engaged position where sockets 202 are secured in receptacles 106 and a disengaged position where sockets 202 are removable. Locking member 108 has an arm 113 on each end that is generally the length of a sliding groove 116 on insert 104. Referring to FIG. 5, each arm 113 has a sliding head 114 that is round to correspond to a rounded end 116*a* of sliding groove 116, and sliding head 114 moves with locking member 108 and slides in sliding groove 116 between the engaged and disengaged positions. When locking member 108 reaches rounded end 116*a*, locking member 108 pivots downwardly around sliding head 114 away from receptacles 106 to allow sockets 202 to be removed.

Figure 3:
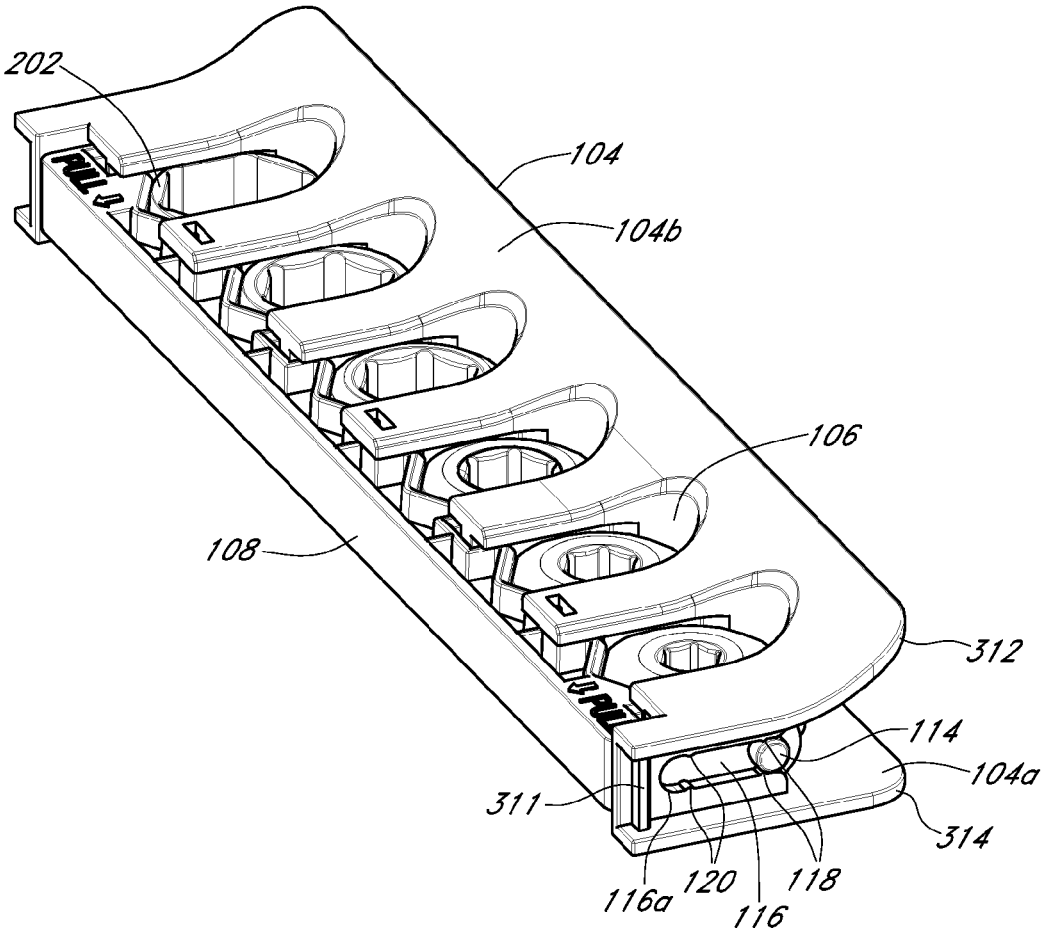
FIG. 3 is a perspective view of the insert and the locking member from the right side of FIG. 1 with the locking member in the engaged position.

Referring to FIGS. 3-5, a lock is provide to hold locking member 108 in the engaged position to prevent sockets 202 from inadvertently falling out of their corresponding receptacles 106. FIG. 3 illustrates locking member 108 in the engaged, locking position. In the illustrated embodiment, the lock is defined by a pair of opposing first detents 118 positioned at an end of groove 116 opposite rounded end 116*a*. First detents 118 protrude into groove 116 to decrease slightly the width of groove 116. An external force is required to move sliding head 114 past first detents 118, and when moved beyond, locking member 108 is secured in the engaged position.

A pair of second detents 120 is provide near rounded head 116*a* of groove 116. Second detents 120 operate similar to first detents 118. An external force is required to move sliding head 114 past second detents 120, and when moved beyond, locking member 108 is held in a disengaged position where it is allowed to pivot about rounded head 116*a*, but not move laterally back toward the engaged position without an external force to overcome second detents 120.

The interaction between grooves 116 on insert 104 and sliding head 114 on locking member 108 require locking member 108 to move linearly outward with respect to insert 104 and pivot downward. This movement allows locking member to be pivoted outward and away from receptacles 106 to the disengaged position, thereby allowing sockets 202 to be freely removed. Thereafter, locking member 108 can be moved back to the engaged position to secure sockets 202 in their corresponding receptacles 106. This arrangement provides utility for case 100 after the point of sale as a permanent storage case 100 for hand tool 200 and its sockets 202.

At the point of sale, it is desirable to lock locking member 108 in the engaged position to prevent sockets 202 from being removed. An aperture 122 extends through at least one arm 110 and a corresponding aperture 124 extends through locking member 108. In the engaged position, aperture 122 and corresponding aperture 124 are aligned so a lock, such as a zip-tie, plastic tab, or the like (not shown) can be positioned therethrough to further secure locking member 108 to insert 104. In the illustrated embodiment three apertures 122 and three corresponding apertures 124 are positioned on every other arm 110.

Hand tool 200 is positioned on case 100 generally between the two inserts 104. As best seen in FIGS. 1, 6 and 7, a retaining member 206 is provided to selectively engage a handle 200*a* of hand tool 200. Retaining member 206 is comprised of a pair of opposing arms 206*a* protruding perpendicularly upward and inward toward each other to form a perpendicular hook 206*b*. Opposing arms 206 are made of a material that is sufficiently bendable so that handle 200*a* of hand tool 200 can be pushed downward into retaining member 206, which causes arms 206*a* to bend until hand tool 200 seats in position, at which the hooks 206*b* of will snap back over handle 206*a* to secure it in place on the case 100.

In the illustrated embodiment, hand tool 200 has a rounded head 200*b* with an aperture therethrough adapted to receive interchangeable sockets 202. Rounded head 200*b* is pivotally attached to handle 200*a* of hand tool 200 at a ratcheting joint 200*c*. Head 200*b* of hand tool 200 is securely attached to case 100 at the point of sale, while allowing handle 200*a* to pivot upward to test a function of hand tool 200.

Another insert is formed in case 100 to hold head 200*b* of hand tool 200. An aperture (not shown) is formed in case 100 generally aligned with the anticipated position of rounded head 200*b*. An insert (not shown) shaped to receive rounded head 200*b* is formed to fit in the aperture of case 100. A portion of the insert shaped like a socket protrudes upward from case 100 and rotates with respect to the case about an axis. The socket shaped portion is received by rounded head 200*b* of hand tool 200 to allow a ratcheting function of hand tool 200 to be tested.

Head 200*b* of hand tool 200 is attached to the insert by a cap 208. The insert has an aperture aligned with head 200*b* to receive cap 208. An arm (not shown) extends from cap 208 through the aperture and is secured in position underneath case 100 by a clevis (not shown). Head 200*b* is secured to case 100 and engaged with socket shaped insert, so a potential purchaser can test a function of hand tool 200 at the point of sale without separating hand tool from case 100.

In the illustrated embodiment, a second insert 210 is provided at the top of case 100 to hold an adapter 212. Adapter 212 has an outer periphery to mate with the inner peripheral wall of rounded head 200*b*. Two arms 212*a*, a ¼" and ⅜" drive, extend outward and are designed to receive standard sockets. Second insert 210 is designed to secure adapter 212 by its arms 212*a* to case 100.

In an alternative embodiment, illustrated in FIGS. 8-11, a typical socket 202*b* is illustrated. Sockets 202*b* of this type have a working axis about which they are rotated when acting on a fastener (not shown). Socket 202*b* is positioned on a post 205 projecting outward with respect to insert 104 with its working axis generally aligned with the center of post 205. Post 205 further has a generally square profile to correspond with a ¼" or ⅜" drive typical for sockets 202*b*.

Locking member 108 extends the length of insert 104. Locking member 108 moves similar to the first embodiment between the engaged and disengaged position to selectively secure sockets 202*b* to insert 104. In the engaged position, locking member 108 is in front of sockets 202*b* to prevent sockets 202*b* from being removed or inadvertently separated from posts 205. Alternative embodiments are anticipated for securing other types of work pieces to insert 104, such as screw drivers ends 202*c* shown in FIG. 11. In such an embodiment, the work piece is cradled in an impression formed in the insert and held in place by a lid (not shown) that is pivotally attached to insert 104.

Figure 9:
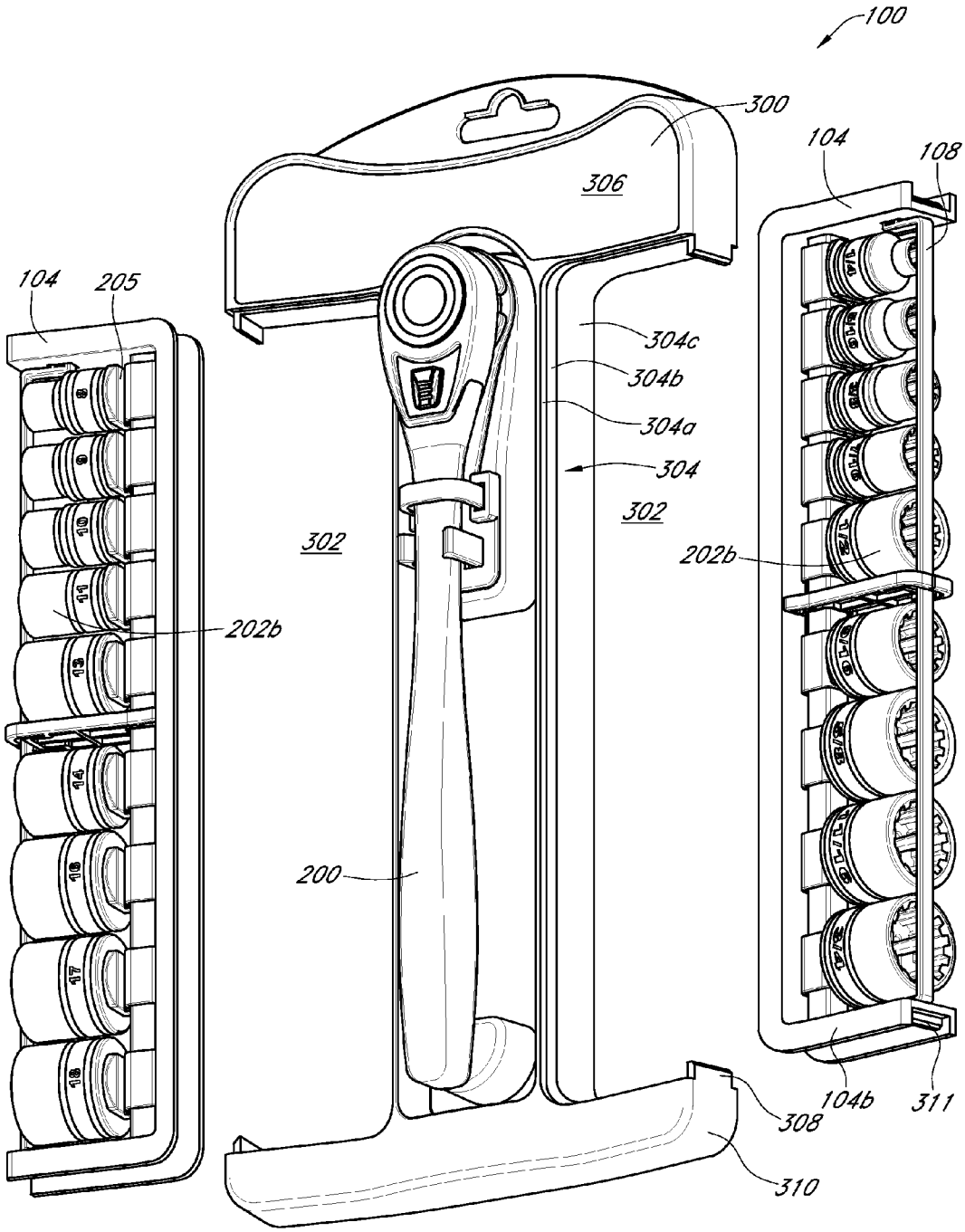
FIG. 9 is a perspective view of the embodiment of FIG. 8 with the inserts apart from a body for the case.
Figure 10:
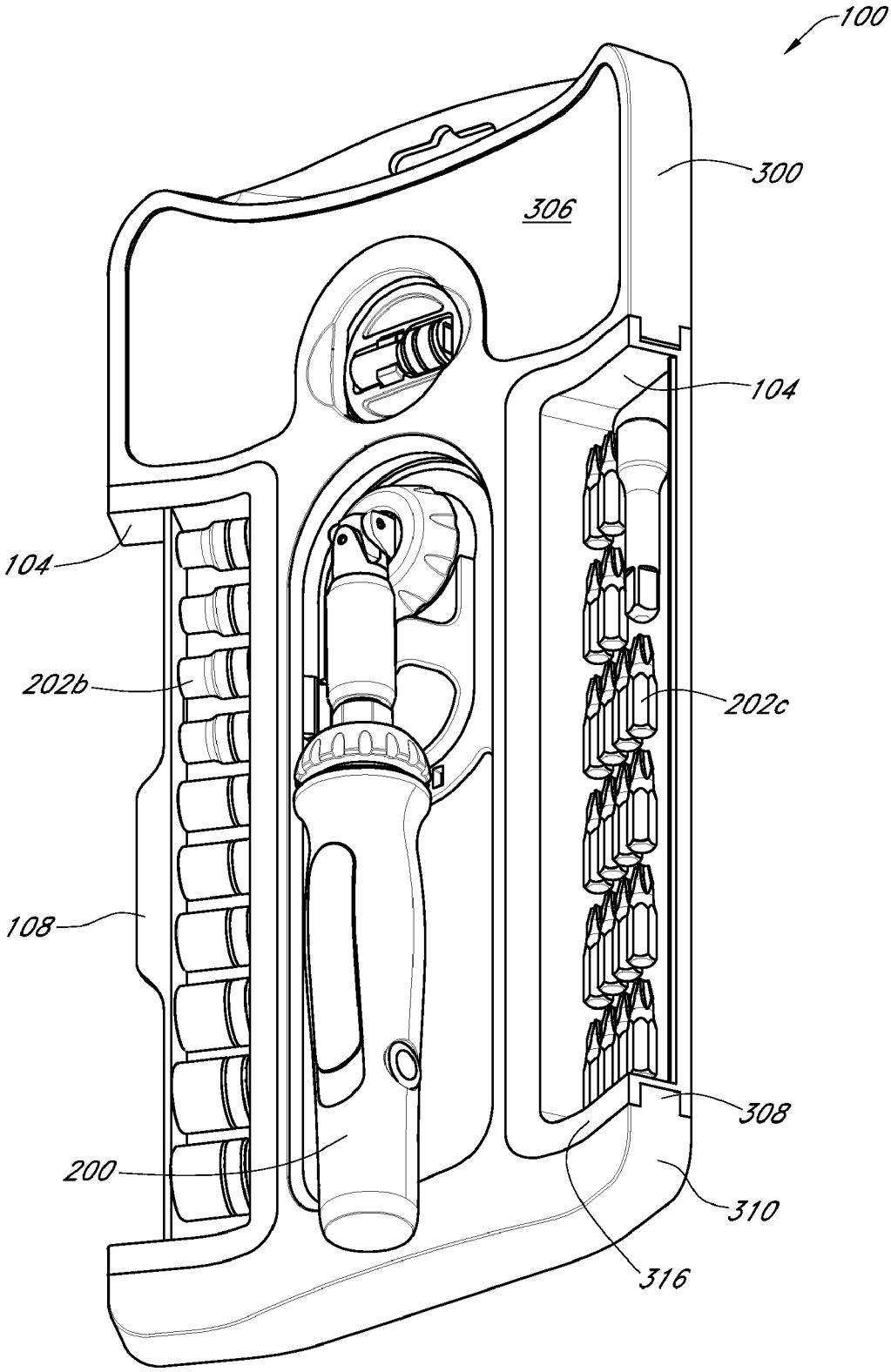
FIG. 10 is a perspective view of yet another embodiment of the case.

FIGS. 3, 9, and 10 show different embodiments of insert 104 for case 100. All the embodiments utilize similar means for retaining inserts 104, and case 100 is configured for exchanging the different embodiments of inserts 104. This allows the manufacturer to use a single base 300 for a variety of hand tools and interchange inserts designed for holding alternative styles of work pieces. FIGS. 8-11 depict alternative embodiments of case 100 to hold and display alternative styles of hand tools and work pieces.

Figure 11:
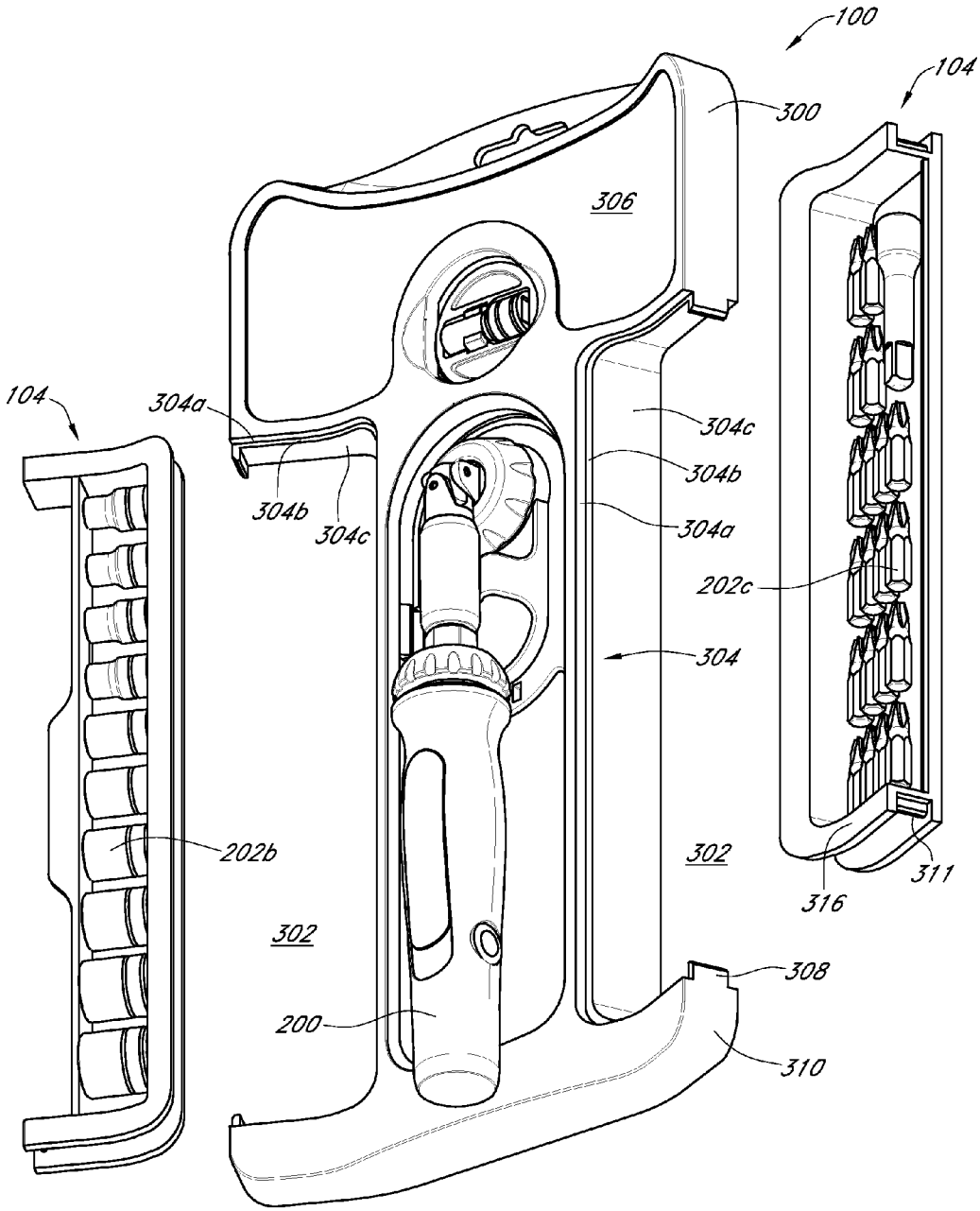
FIG. 11 is a perspective view of the embodiment of FIG. 10 with the inserts apart from a body for the case.

Inserts 104 are snapped to base 300 during the packaging process. Referring to FIGS. 9 and 11, case 100 is shown with inserts 104 and 104*b* detached and apart from base 300. Base 300 has a step 304 that extends generally around cut-out 302 and is defined by three portions 304*a,b*, and *c*. First portion 304*a* extends downward generally perpendicular with respect to the customer facing side 306 of base 300. Second portion 304*b* extends outward with respect to first portion 304*a* toward cut-out 302. Third portion 304*c* extends downward with respect to second portion 304*b* generally perpendicular thereto. The two opposing sides of the cut-out have a distance between corresponding first portions 304*a* greater than the distance between corresponding third portions 304*c*. Third portion 304*c* extends into insert 104 to hold insert 104 to base 306.

A stop 308 is positioned on base 300 and formed by cut-out 302. Stop 308 is generally perpendicular to customer facing side 306 and generally continuous with a side 310 of base 300 generally perpendicular to customer facing side 306. Stop 308 extends inward with respect to cut-out 302 a distance greater than the length of second portion 304*b* of step 304. Stop 308 is configured to engage insert 104 at a corresponding protrusion 311 (best seen in FIGS. 2-4) to prevent insert 104 from sliding outward after insert 104 is attached to base 300.

FIG. 3 shows insert 104 with a top and a bottom edge 312 and 314, respectively, that extends around a portion of the periphery of insert 104 that is received in cut-out 302. Top edge 312 and bottom edge 314 are formed around the top 104*b* and bottom 104*a* of insert 104 a distance about equal to the width of step 304. This allows insert 104 to be fitted into cut-out 302 of base 300 and snapped into place with top edge 312 overlapping second portion 304*b* of step 304 and bottom edge 314 overlapping a bottom edge (not shown) of base 300.

When insert 104 is positioned in base 300 case 100 has a generally continuous profile on each side. Locking member 108 is generally flush with side 310 of base 300 and top face 104*b* of insert 104 is generally flush with display face 306 of base 300.

The case herein described provides the manufacturer with flexibility to meet changing demand for new and different products, while minimizing the amount of packaging parts. A single style of base 300 can be used as packaging for numerous styles of hand tools and inserts 104, which can be exchanged to meet customer demands.

While the present invention has been particularly shown and described with reference to exemplary embodiments thereof, it should be understood by those of ordinary skill in the art that various changes, substitutions and alterations could be made herein without departing from the scope of the invention as defined by appended claims and their equivalents. It is intended that various aspects of various embodiments can be combined in new combinations to create new embodiments within the scope of the invention. The invention can be better understood by reference to the following claims. For purpose of claim interpretation, the transitional phrases "including" and "having" are intended to be synonymous with the transitional phrase "comprising."

What is claimed is:

1. A holder for interchangeable work pieces having an outer surface and a working axis, comprising:

an insert having outer ends with a plurality of receptacles at spaced apart intervals between the outer ends for individual reception of the interchangeable work pieces, wherein each outer end of the insert includes a groove;

a locking member combined with the insert and moveable between an engaged position and a disengaged position to selectively secure the interchangeable work pieces in the receptacles of the insert, wherein each end of the locking member includes a head that is received in the groove for movement along the groove between the engaged and disengaged positions;

a receptacle receives the work piece around the outer surface of the work piece that is generally parallel to the working axis of the work piece, and the locking member in engaged position engages the outer surface of the work piece;

a lock including a detent extending inward in the groove and positioned generally at an end of the groove, wherein the detent decreases the width of the groove such that an external force is required to move the sliding head of the locking member past the detent, and wherein the lock secures the locking member in the engaged position; and a first aperture extending through the locking member and a second aperture extending through the insert, the apertures adapted to be aligned so as to receive a removable member to fix the locking member in the engaged position at a point of sale.

2. A holder for interchangeable work pieces, comprising;

an insert having outer ends with a plurality of receptacles at spaced apart intervals between the outer ends for individual reception of the interchangeable work pieces;

a locking member combined with the insert and moveable between an engaged position and a disengaged position to selectively secure the interchangeable work pieces in the receptacles of the insert, wherein each receptacle is defined on each side by an arm having a generally I-shape profile formed with two parallel lateral portions spaced a part by a perpendicular portion, wherein the length of the perpendicular portion corresponds generally to a depth of the work piece, the work piece in the receptacle being constrained from sideways movement by the perpendicular portions and being constrained from upward and downward movement by the two lateral portions.

3. The holder for interchangeable work pieces of claim 2, and further comprising a groove in each outer end of the insert, and a head on each end of the locking member, the head being received in the groove for movement along the groove between the engaged and disengaged positions.

4. The holder for interchangeable work pieces of claim 3, and further comprising a lock to secure the locking member in the engaged position.

5. The holder for interchangeable work pieces of claim 4, and the lock further comprising a detent extending inward in the groove and positioned generally at an end of the groove, wherein the detent decreases the width of the groove such that an external force is required to move the sliding head of the locking member past the detent.

6. The holder for interchangeable work pieces of claim 5, and further comprising a first aperture extending through the locking member and a second aperture extending through the insert, the apertures adapted to be aligned so as to receive a removable member to fix the locking member in the engaged position at a point of sale.

7. A case for holding and displaying a hand tool and a plurality of interchangeable work pieces at a point of sale, the case comprising:

a base;

an insert combined with the base and having outer ends with a plurality of receptacles at spaced apart intervals between the outer ends for individual reception of the interchangeable work pieces, wherein at least one of the receptacles is defined on each side by an arm having a generally I-shape profile formed with two parallel lateral portions spaced a part by a perpendicular portion, wherein the length of the perpendicular portion corresponds generally to a depth of the work piece, the work piece in the receptacle being constrained from sideways movement by the perpendicular portions and being constrained from upward and downward movement by the two lateral portions; and a locking member combined with the insert and moveable with respect to the insert between an engaged position and a disengaged position to selectively secure the interchangeable work pieces in the receptacles of the insert.

8. The case of claim 7, and further comprising a groove on each end of the insert, and a head on each end of the locking member, the head being received in the groove for movement about the groove such that the locking member is limited in movement between the engaged and disengaged positions by the groove.

9. The case of claim 8, and further comprising a lock to secure the locking member in the engaged position.

10. The case of claim 9, and the lock further comprising a detent extending inward in the groove and positioned generally at an end of the groove, wherein the detent decreases the width of the groove such that an external force is required to move the sliding head past the detent.

11. The case of claim 10, and further comprising an aperture extending through the locking member and the insert, the aperture adapted to receive a lock to disposable lock to fix the locking member in the engaged position at a point of sale.

12. The case of claim 11, and the locking member further comprising a generally rectangular portion that extends the length of the plurality of receptacles, the rectangular portion having an inner side wall that touches the work piece when the locking member is in the engaged position, the inner side wall having at least one v-shaped notch where each side of the v-shaped notch touches the second portion of the outer surface of the work piece that is generally parallel to the working axis.

13. A package for holding and displaying a hand toot and a work piece for the hand tool at a point of sale, the package comprising:

a base adapted to secure the hand tool to the base at the point of sale, the base having a profile defining a cut-out with a portion of the base adjacent to the cut-out having a step below a customer facing side of the base extending around the perimeter of the cut-out, wherein the step has a first portion extending downward generally perpendicular with respect to the customer facing side of the base and a second portion extending outward toward the cut-out with respect to the first portion and a third portion extending downward generally perpendicular with respect to the second portion, wherein the two opposing sides of the cut-out have a distance between corresponding first portions greater than the distance between corresponding third portions; wherein the first step portion, the second step portion, and the third step portion extend continuously around the perimeter of the cut-out; and an insert adapted to hold the work piece secure to the insert at the point of sale, the insert having a profile shaped generally as the cut-out and configured to attach to the base, wherein the third portion extends into the insert to secure the insert to the base and form a generally continuous profile between the insert and the base.

14. The package of claim 13, and the insert further comprising a plurality of receptacles at spaced apart intervals therealong for individual reception of the interchangeable work pieces, and a locking member attached to the insert and moveable between an engaged position and a disengaged position to selectively secure the interchangeable work pieces to the insert.

15. The package of claim 13, and further comprising a stop positioned on the base and formed by the cut-out, the stop being generally perpendicular to the customer facing side and generally continuous with a side of the base generally perpendicular to the customer facing side, and extending inward with respect to the cut-out a distance greater than the length of the second portion of the step, the stop engaging insert to prevent the insert from sliding outward after the insert is attached to the base.

16. A case for holding and displaying a plurality of interchangeable work pieces at a point of sale, the case comprising:

a plurality of receptacles, wherein each receptacle receives a work piece; and a locking member positioned for movement with respect to the receptacles between an engaged position with the locking member touching an outer surface of the work piece having a normal vector that is perpendicular to a working axis of the work piece and a disengaged position to selectively secure the interchangeable work pieces in their corresponding receptacle, wherein at least one of the receptacles is defined on each side by an arm having a generally I-shape profile formed with two parallel lateral portions spaced a part by a perpendicular portion, wherein a length of the perpendicular portion corresponds generally to a thickness of the work piece measured along the working axis, wherein when the work piece is in the receptacle it is constrained from sideways movement by the perpendicular portions and is constrained from upward and downward movement by the two lateral portions.

17. The case of claim 16, wherein the locking member does not resist movement of the work piece co-axial with the working axis.

18. The case of claim 16, wherein the locking member does not resist movement of the work piece co-axial with the working axis.

19. The case of claim 16, and further comprising an insert, wherein the plurality of receptacles are positioned at spaced apart intervals between outer ends of the insert for individual reception of the interchangeable work pieces, wherein each outer end of the insert includes a groove, wherein the locking member has a head at each end that is received in the groove for movement along the groove between the engaged and disengaged positions.

20. The case of claim 19, and further comprising a lock including a detent extending inward in the groove and positioned generally at an end of the groove, wherein the detent decreases the width of the groove such that an external force is required to move the head of the locking member past the detent, and wherein the lock secures the locking member in the engaged position.

21. The case of claim 20, and further comprising a first aperture extending through the locking member and a second aperture extending through the insert, wherein when the first and the second apertures are aligned a removable member is positioned therethrough to fix the locking member in the engaged position at a point of sale.

22. The case of claim 16, and further comprising a base adapted to secure a hand tool to the base at a point of sale, the base having a profile defining a cut-out with a portion of the base adjacent to the cut-out, and wherein the insert has a profile shaped generally as the cut-out and attachable to the base and form a generally continuous profile between the insert and the base.

23. The case of claim 22, wherein the cut-out has a step below a customer facing side of the base extending around the perimeter of the cut-out, wherein the step has a first portion extending downward generally perpendicular with respect to the customer facing side of the base and a second portion extending outward toward the cut-out with respect to the first portion, and a third portion extending downward generally perpendicular with respect to the second portion, wherein the two opposing sides of the cut-out have a distance between corresponding first portions greater than the distance between corresponding third portions, wherein the third portion extends into the insert to secure the insert to the base.

* * * * *